US005736500A

United States Patent [19]

Farnworth et al.

[11] Patent Number: 5,736,500

[45] Date of Patent: Apr. 7, 1998

[54] AQUEOUS MICROEMULSIONS COMPRISING ALKOXYLATED ALCOHOL NONIONIC SURFACTANT IN SUBSTAINIALLY WATER-INSOLUBLE SOLVENT AND OIL

[75] Inventors: Donald Michael Farnworth, Merseyside; Alexander Martin, Cheshire, both of United Kingdom

[73] Assignee: Lever Brothers Company, Division of Conopco, Inc., New York, N.Y.

[21] Appl. No.: 413,069

[22] Filed: Mar. 29, 1995

[30] Foreign Application Priority Data

Mar. 31, 1994 [GB] United Kingdom ..... 9406459
Jul. 6, 1994 [GB] United Kingdom ..... 9413653

[51] Int. Cl.[6] ..... C11D 17/00; C11D 1/72; C11D 3/43; C11D 3/44

[52] U.S. Cl. ..... 510/417; 510/197; 510/238; 510/365; 510/421; 510/432; 510/505; 510/506

[58] Field of Search ..... 252/174, 173, 252/DIG. 14, 174.21, DIG. 1, 170, 162, 174.11, 171; 510/417, 197, 238, 365, 421, 432, 505, 506

[56] References Cited

U.S. PATENT DOCUMENTS

| | | | |
|---|---|---|---|
| 4,511,488 | 4/1985 | Matta | 510/421 |
| 4,869,842 | 9/1989 | Denis et al. | 252/121 |
| 4,909,962 | 3/1990 | Clark | 252/547 |
| 5,035,826 | 7/1991 | Durbut et al. | 252/121 |
| 5,075,026 | 12/1991 | Lolth et al. | 252/122 |
| 5,076,954 | 12/1991 | Lolth et al. | 252/122 |
| 5,112,516 | 5/1992 | Koetzle | 252/162 |
| 5,176,986 | 1/1993 | Telser et al. | 430/306 |
| 5,213,624 | 5/1993 | Williams | 134/40 |

FOREIGN PATENT DOCUMENTS

| | | |
|---|---|---|
| 2013431 | 9/1993 | Canada . |
| 335 471 | 4/1989 | European Pat. Off. . |
| 316 726 | 5/1989 | European Pat. Off. . |
| 368 146 | 11/1989 | European Pat. Off. . |
| 347 110 | 12/1989 | European Pat. Off. . |
| 3-76797 | 4/1991 | Japan . |
| 3-767974 | 4/1991 | Japan . |
| 2 144 763 | 3/1985 | United Kingdom . |
| 2 190 681 | 11/1987 | United Kingdom . |

OTHER PUBLICATIONS

PCT Search Report date Jun. 28, 1995, for PCT/EP95/00989.

Kirk–Othmer, vol. 2, p. 954 (undated).

*Primary Examiner*—Ardith Hertzog
*Attorney, Agent, or Firm*—A. Kate Huffman

[57] ABSTRACT

Improved microemulsions having a lower level of solvent, a lower level of oil, a more robust formulation and/or exhibiting equivalent if not better performance on fatty soils can be obtained by simultaneous selection of specific surfactants, specific oils and specific solvents. When all three of these components are selected in the manner described herein, a synergistic benefit is attained. The present invention provides a liquid, aqueous cleaning composition in the form of a stable emulsion having a dispersed phase diameter of 10–100 nanometres comprising:

a) at least 30 wt % water, b) at least 1 wt % but not more than 40 wt % of a surfactant system comprising at least one alkoxylated alcohol nonionic surfactant and not more than 10 wt % on alkoxylated alcohol nonionic surfactant of anionic surfactant, c) at least 2 wt % but not more than 20 wt % of a solvent having a solubility of less than 12% w/w in water, and, d) at least 0.2 wt % but less than 10 wt % of a substantially water-insoluble oil which is a solvent for fats.

5 Claims, 1 Drawing Sheet

AQUEOUS MICROEMULSIONS COMPRISING ALKOXYLATED ALCOHOL NONIONIC SURFACTANT IN SUBSTAINIALLY WATER-INSOLUBLE SOLVENT AND OIL

TECHNICAL FIELD

The present invention concerns surfactant-oil microemulsions, especially those suitable for use as cleaning compositions.

BACKGROUND OF THE INVENTION

Aqueous cleaning compositions generally comprise at least one surfactant component. Many known cleaning compositions further comprise water-immiscible components, such as oils, fatty alcohols and/or terpenes. It is known that systems comprising a surfactant, water and these water immiscible components can assume different phase structures.

Three types of phase which comprise surfactant and water are generally recognised: the rod-phase, the lamellar phase and the spherical micellar phase.

In the spherical phase, surfactant molecules align in spheres having a diameter approximately twice the molecular length. For anionic actives in common use, these structures are less than 10 nm in diameter. Systems exhibiting this phase structure are clear, have a viscosity similar to water and cannot suspend particles.

The rod phase can be considered as a spherical phase which has been encouraged to grow along one dimension. It is known that this can be achieved by the addition of oils. Typically, the rods grow to very large dimensions resulting in highly viscous solutions. Although the viscosity of these systems is high, suspended particles will eventually phase separate.

The lamellar phase is believed to be characterised by the presence of extensive bi-layers of aligned surfactant molecules separated by water layers. These systems are generally of lower viscosity than the rod phase systems, can be opaque and can suspend particles.

When an oil is added to a surfactant-water system the oil can remain in a separate phase or form part of a mixed phase. The so-called 'microemulsions' are believed to be oil-in-water emulsions wherein the oil droplets are sufficiently small that a visibly clear system results. For the purposes of the present invention, the term 'microemulsion' is restricted to those systems in which particle size measurements reveal a particle size range of 10–100 nm. These systems have a low viscosity and will not suspend particles, but differ from spherical micelles in that they exhibit low interfacial tensions in the presence of other oily materials such as are common in fatty soils.

It is believed that the low interfacial tension enables the microemulsions to spontaneously emulsify such oily materials, giving a particular cleaning benefit as compared with spherical micelles.

As will be appreciated, microemulsions have a similar overall composition to the rod micellar systems which can be obtained by adding oil to a spherical micellar system but have a completely different phase structure and distinct physical properties. It is believed that in the microemulsions the oil phase is segregated into discrete spherical droplets stabilised by a surfactant shell whereas in the rod phase, the oil phase is mixed with the surfactant to form a cylindrical mixed micellar structure.

In many applications it is important that a composition should be sufficiently robust that it remains a microemulsion following some dilution. If dilution takes the composition into a rod phase it is possible that the resulting increase in viscosity will hinder further dilution. If slight dilution takes the composition into the spherical miscellar phase the advantages of a microemulsion are lost, especially if physical separation of the oil phase occurs.

GB 2190681 (Colgate: 1987) and EP 316726 (Colgate: 1987) relate to systems which comprise both anionic and nonionic surfactant, together with a cosurfactant, a water-immiscible hydrocarbon such as an oily perfume and water. Surfactants may comprise solely anionic surfactants although mixtures of anionics and nonionics are preferred. According to these texts, (see page 5, lines 31ff. of the GB specification) the cosurfactant is essential in that in the absence of this component the surfactants and the hydrocarbon will form a non-microemulsion phase structure. Suitable cosurfactants are said to include glycol ether solvents such as Butyl Carbitol (RTM) which is miscible with water and Butyl Cellosolve (RTM) which is highly water soluble. As will be discussed hereafter with reference to examples, these systems are very sensitive to the type of surfactant present and it appears difficult to reproduce these systems without using the precise components specified in the prior art.

GB 2144763 (P&G: 1983) relates to microemulsion systems which contain magnesium salts. Examples demonstrate that aqueous liquid compositions can be prepared with anionic surfactants alone and with mixtures of anionic and nonionic surfactants.

U.S. Pat. No. 4511488 (Penetone: 1985) relates to compositions which are described as clear, flowable compositions and which comprise 10–60 wt % of d-limonine (a citrus oil), 10–30 wt % surfactant, and, 20–70 wt % water, in the presence of a coupling agent such as a glycol ether solvent, in particular Butyl Carbitol. It has been found by experiment that these compositions are not stable and phase separate rapidly on standing.

From the above it can be seen that microemulsions generally comprise water, a surfactant mixture, an oil and a solvent. The surfactants are typically mixtures of anionic and nonionic surfactant. The oil is generally a perfume oil. The solvent is often referred to as a 'cosurfactant' or a 'coupling agent' and is generally a glycol ether.

SUMMARY OF THE INVENTION

We have determined that improved microemulsions having a lower level of solvent, a lower level of oil, a more robust formulation and/or exhibiting equivalent if not better performance on fatty soils can be obtained by simultaneous selection of specific surfactants, specific oils and specific solvents. When all three of these components are selected in the manner described herein, a synergistic benefit is attained.

Accordingly, the present invention provides a liquid, aqueous cleaning composition in the form of a stable emulsion having a dispersed phase diameter of 10–100 nanometres comprising:

a) at least 30 wt % water, b) at least 1 wt % but not more than 40 wt % of a surfactant system comprising at least one alkoxylated alcohol nonionic surfactant and not more than 10 wt % on alkoxylated alcohol nonionic surfactant of anionic surfactant, c) at least 2 wt % but not more than 20 wt % of a solvent having a solubility of less than 12% w/w in water, and, d) at least 0.2 wt % but less than 10 wt % of a substantially water-insoluble oil which is a solvent for fats.

The invention extends to a method of cleaning a hard surface which comprises the step of treating the surface with a composition as defined above and as described herein.

Figure 1:
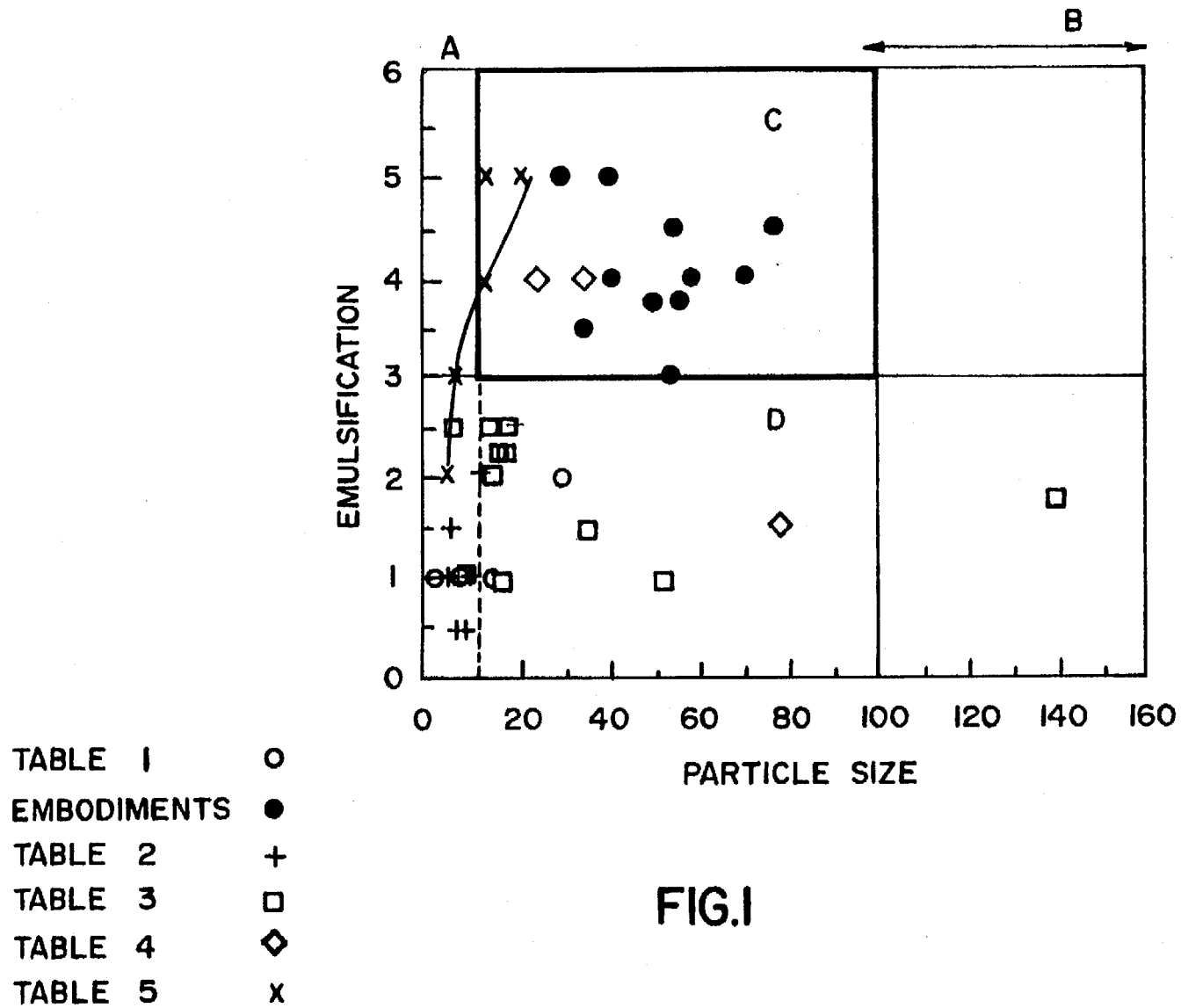
FIG. 1 is a graph illustrating the relationship of emulsification to particle size according to the invention.

It is believed that the combined use of nonionic surfactant in the presence of low levels of anionic surfactant or preferably the complete absence of anionic surfactant, together with relatively low levels of relatively water-insoluble solvent and less than 10% of a water-insoluble oil leads to the formation of a microemulsion which exhibits improved fatty soil removal when compared with known compositions which contain conventional levels of anionic or which employ higher levels of solvent and/or oil.

It is believed essential that the compositions of the present invention are microemulsions. The physical state of the compositions can be determined by measurement of the particle size in the composition. As mentioned above microemulsions are characterised by a particle size of 10–100 nm. As will be shown hereinafter with reference to experimental results compositions which have a particle size outside of this range do not exhibit spontaneous emulsification of fatty soils.

Typical compositions according to the present invention exhibit a low interfacial tension, i.e. an interfacial tension of less than 1 dyne/cm when measured after 30 min equilibration using a Kruss spinning drop tensiometer SITE 04 (TM) operating at 22–23 Celcius, 2000–3000 rpm in accordance with the manufacturers instructions and injecting olive oil (ex Sigma).

Surfactants

It is essential that the compositions of the invention comprise alkoxylated alcohol nonionic surfactant.

Suitable alkoxylated alcohol nonionic surfactants can be broadly described as compounds produced by the condensation of alkylene oxide groups, which are hydrophillic in nature, with an organic hydrophobic compound which may be aliphatic or alkyl aromatic in nature.

The length of the hydrophillic or polyoxyalkylene radical which is condensed with any particular hydrophobic group can be readily adjusted to yield a water-soluble compound having the desired degree of balance between hydrophillic and hydrophobic elements.

Particular examples include the condensation product of aliphatic alcohols having from 8 to 22 carbon atoms in either straight or branched chain configuration with ethylene oxide, such as a fatty alcohol ethylene oxide condensate having from 2 to 15 moles of ethylene oxide per mole of fatty alcohol. A plurality of such materials are described in Schick, 'Nonionic Surfactants', [pub. Arnold, New York].

Particularly preferred nonionic surfactants are those wherein the average composition conforms to the general formula $C_{2n}E_{(n+/-2)}$.

Particularly preferred surfactants include the $C_{8-13}E_{4-8}$ (average) alcohol ethoxylates. Examples of these materials include IMBENTIN 91-35 OFA (RTM) and DOBANOL 23-6.5 (RTM).

Alternatives include the condensates of alkylphenols whose alkyl group contains from 6 to 12 carbon atoms with 5 to 25 moles of ethylene oxide per mole of alkylphenol. The alkyl nonionics are preferred over the alkylphenyl nonionics for environmental and ease of formulation reasons.

It is believed that shorter EO chain nonionics suffer from the disadvantage of a reduced cloud point, whereas longer EO chains lead to a surfactant which is difficult to formulate into a microemulsion phase.

Preferably, the nonionics have a monomodal distribution of EO chain lengths, i.e. mixtures of different ethoxylates are not preferred.

The amount of nonionic detergent active to be employed in the detergent composition of the invention, when formulated as conventional products, will generally be from 1 to 20%, preferably from 1 to 15%, and most preferably from 5 to 10% by weight. For concentrated products levels of nonionic of 20–30% are preferred.

As mentioned above it is believed essential that the surfactant should contain no more than low levels of, or preferably be free of, anionic surfactant. While some anionic surfactant can be tolerated, the level is less than 10%, more preferably less than 5% of the total nonionic surfactant present. Compositions which comprise significant levels of anionic surfactant do not exhibit spontaneous emulsification of fatty soils. Moreover, certain compositions which contain more than very low levels of anionics exhibit a thick rheology.

Suitable anionic surfactants suitable for use at low levels in the compositions of the invention include fatty acid soaps and alcohol sulphates. Other anionics, as are known in the art, are not intended to be excluded from use in embodiments of the invention.

It is preferred that the compositions of the present invention comprise less than 5% wt on total nonionic surfactants of cationic surfactants and more preferred that the compositions are essentially free of cationic surfactants.

Solvents

It is believed essential that the solvent is one having a low aqueous solubility.

It is particularly preferred that the aqueous solubility should lie in the range 4–11%. Solubility can be determined by experimental methods known to the skilled worker.

Solvents which have an aqueous solubility above 11% w/w in water, such as ethanol (miscible), 2-butanol (solubility >20%), isopropyl alcohol (miscible), ethylene glycol derivatives (including butoxy ethanol [available as Butyl Cellosolve (TM)]: miscibility >20%), Butyl Digol (miscible) and diethylene glycol (miscible) do not give good results. It is preferred that the compositions according to the invention are essentially free of these solvents.

The preferred alcoholic solvents include n-Butanol (soluble to 8% wt in water) and iso-butanol (soluble to 10% wt in water).

Relatively insoluble glycol ethers are particularly preferred. We have determined that excellent performance is attained when the solvent has a solubility in water of from 5–10%. Solvents which are particularly preferred are those selected from the group comprising n-butoxy propanol (available as Dowanol PnB (RTM): soluble to 6%), di-propylene glycol monobutyl ether (available as Dowanol DPnB (RTM): soluble to 5%) and mixtures thereof.

Mixtures of solvents having an aqueous solubility in the range 4–11% with other, more highly water-soluble solvents having an aqueous solubility above 12% are not excluded, but is preferred that the more highly water-soluble solvents are absent.

Oils

For applications where the composition of the invention is intended to remove fatty soil it is believed that the oil must be a good solvent for fatty soils, especially those containing triglyceride. The rate at which any particular fatty soil dissolves in an oil can be simply determined by experiment.

These oils have a miscibility with water of less than 1%. Preferred oils are either:

a) cyclic hydrocarbons having 6–15 carbon atoms, or, b) ethers of 2–6 carbon alcohols, or, c) mono-esters of 2–6 carbon fatty acids with 2–6 carbon alcohols, wherein for (b) and (c) the total carbon number of the molecule is 6–10.

Preferred cyclic hydrocarbon oils are limonine and para-cymene. Preferred ethers include di-butyl ether. Preferred esters include butyl butyrate and amyl acetate. These are all hydrophobic liquids which can rapidly dissolve >20% of their own weight of triglyceride.

Longer chain esters such as ethyl decanoate are less preferred. These will dissolve sufficient quantity of fat but are believed to do so too slowly for effective cleaning.

Non-cyclic hydrocarbon oils such as dodecane and hexadecane, and branched species such as citral (polar acyclic terpene) and the ISOPAR (TM) series (branched chain hydrocarbons) and water insoluble alcohols such as n-decanol, which dissolve less than 15% w/w of fat over a long period (several hours) and are considered less suitable for use in those embodiments of the present invention where fatty soil removal from hard surfaces is important.

It is particularly preferred that the ratio between the weight percentages of the solvent (c) and the oil (d) is such that (c):(d)>1:1. In the most preferred embodiments of the invention the ratio is 1.5–10.

For other applications the important properties of the oil can extend beyond an ability to dissolve fatty soil. It is envisaged that by choice of a suitable oil embodiments of the invention might ensure delivery of a persistent perfume a sunscreen or an insect repellant.

Minors

Various inessential components can be present in the compositions of the present invention where these are adapted to particular uses. These can be selected from the usual components employed such as perfumes, preservatives, colouring agents, antifoaming components, polymers, pH modifiers and the like, providing that the composition retains its micro-emulsion form when these components are added.

Hydrotropes are optional components of the compositions according to the invention. The level of hydrotrope should preferably not exceed 10% of the weight of nonionic surfactant present. Suitable hydrotropes include: aromatic sulphonates such as cumene, xylene and toluene sulphonate. Cumene sulphonate is particularly preferred. The benefit of the addition of the aromatic sulphonate hydrotropes is to increase the cloud point of the compositions without requiring the addition of anionic surfactants to inhibit the formation of lamellar phases.

Preferred compositions according to the present invention comprise:

a) 5.0–10% wt ethoxylated nonionic surfactant selected from the group comprising: the condensation products ethylene oxide with aliphatic alcohols having from 8 to 22 carbon atoms in either straight or branched chain configuration;

b) 3.0–8.0% wt of a solvent selected from the group comprising: n-Butanol, iso-butanol, n-butoxy propanol, di-propylene glycol monobutyl ether and mixtures thereof, and, c) 0.8–4.0% wt of an oil selected from the group comprising: limonine, para-cymene, di-butyl ether, butyl butyrate, amyl acetate and mixtures thereof.

Other preferred compositions according to the present invention comprise:

a) 20–30% wt ethoxylated nonionic surfactant selected from the group comprising: the condensation products ethylene oxide with aliphatic alcohols having from 8 to 22 carbon atoms in either straight or branched chain configuration;

b) 12–20% wt of a solvent selected from the group comprising: n-Butanol, iso-butanol, n-butoxy propanol, di-propylene glycol monobutyl ether and mixtures thereof, and, c) 4.0–10% wt of an oil selected from the group comprising: limonine, para-cymene, di-butyl ether, butyl butyrate, amyl acetate and mixtures thereof.

Both the preferred embodiments comprise at least 30% water although the second above-mentioned preferred compositions are suitable for use as 'concentrates' and will generally contain less water than the first above-mentioned preferred compositions.

In order that the invention may be further understood it will be described hereafter by way of example and with reference to the single accompanying figure. The figure is a graph showing the relation between the particle size of the emulsions and the emulsification performance.

EXAMPLES

In order that the invention may be further understood it will be described hereafter with reference to embodiments of the invention and comparative examples.

Table 1 relates to comparative examples which are similar to the compositions disclosed in GB 2190681. In table 1, the 'NONIONIC' surfactant was Imbentin 91-35 OFA (RTM) a 5EO, 9–11 carbon alcohol ethoxylate similar to that mentioned in GB 2190681, the 'ANIONIC' surfactant was the sodium salt of a 13–17 carbon paraffin sulphonate and the 'SOLVENT(1)' was Butyl Digol (TM). Two different oils were used, 'OIL(1)' which was Limonene and 'OIL(2)' was Sunclean 114 (TM) a commercially available perfume.

In table 2, SOLVENT(2) was DOWANOL PnB (RTM, ex. DOW) the 'NONIONIC' and 'ANIONIC' were the same as in table 1.

In tables 3–8, 'Imb' is Imbentin 91-35 as mentioned above, whereas 'Dob' is Dobanol (RTM) 23.E6.5, a C12–C13 6.5EO ethoxylated alcohol. Of the solvents mentioned in table 3: 'Digol' is Butyl Digol, IPA is propan-2-ol, PnB is DOWANOL PnB, DPnB is DOWANOL DPnB (as mentioned above), 'Cell' is Butyl Cellosolve and nBuOH is n-butanol. As regards the solvents in table 3: 'Lim' is limonene, 'Dod' is dodecane, 'Dec' is decanol, 'Cit' is citral, 'BuE' is di-butyl ether, 'BuB' is butyl butyrate, 'EtD' is ethyl decanoate and 'pCy' is p-Cymene.

S/O, where calculated, is the weight % ratio of solvent to oil.

'Score (a)' is representative of extent of the spontaneous emulsification which the product exhibits on triglyceride samples on a glass microscope slide. Commercially available lard-'Silver Cloud Fat' (TM) was spread onto the slide using a cotton bud to give a streaky but fairly uniform fat film. The glass slide was then mounted onto a microscope, a drop of test solution placed onto the fat film and the interaction between the liquor and the fat monitored over a few minutes at RT (no mechanical input). The interaction could also be recorded by means of a video camera.

Performance was scored on the following scale:

1 roll-up of fat but no removal, 2 roll-up of fat with minimal removal and/or emulsification, 3 roll-up of fat with moderate and/or incomplete, removal and/or emulsification, 4 roll-up of fat with slow but complete removal and/or emulsification, and, 5 roll-up of fat with rapid and complete removal and/or emulsification.

'Score (b)' is representative of the extent of cleaning using a 'spot test', in which clean Decamel (RTM) tiles are sprayed with a model kitchen soil (a mix of triglycerides, fatty acid, clay and carbon) and allowed to stand at room temperature overnight before use. Alternatively, the soiled tiles were warmed in an oven at 70° C. for 10 minutes to increase soil adhesion to the tile and allowed to cool before use. Samples of liquors were applied to the soiled tiles at room temperature and the drops allowed to spread and remain in contact with the soil for about 20/30 seconds (up to about 4 minutes in the case of particularly ineffective solutions). The spots of liquid were then rinsed under the tap (hard water) or with a wash bottle (demin water). 'Spontaneous Cleaning' was assessed on the following scale according to the amount of visible soil remaining on the tile after rinsing.

5 Excellent—complete soil removal,

4 Good—almost all soil removed,

3 Moderate—a spot with soil still visible but which is markedly cleaner than the surroundings, 2 Poor—some soil removal, 1 Very poor—a very faint 'ring' at the edge of the spot, and, 0 No soil removal.

EXAMPLES 1–9

Comparison with Compositions Known in the Art

TABLE 1

| | Data presented in nanometers Example | | | | | | |
|---|---|---|---|---|---|---|---|
| | 1a | 1b | 1c | 1d | 2a | 4a | 5 |
| Nonionic | 3.0 | 3.0 | 3.0 | 3.0 | 7.0 | 3.0 | 3.0 |
| Anionic | 4.0 | 4.0 | 4.0 | 4.0 | — | 4.0 | — |
| Solvent (1) (Digol) | 4.0 | 4.0 | 4.0 | 4.0 | 4.0 | 4.0 | 4.0 |
| Oil (1) | 1.0 | 0.4 | — | — | — | — | — |
| Oil (2) | — | — | 0.4 | 1.0 | 1.0 | — | 1.0 |
| (a) | 2 | 2 | 2 | 2 | 2 | 2 | 3 |
| (b) | 0 | 0 | 0 | 0 | 0 | 0 | 1 |
| Particle Size | 4.1 | 4.4 | 1.8 | 4.1 | 12.6 | 4.9 | 29.5 |

All the examples in this table are comparative and are illustrative of the performance of known compositions which employ the water-miscible Butyl Digol solvent.

It can be seen that the best results are obtained with the composition given in column 5, but otherwise the results are generally poor, with no soil being removed in the spot test (score (b)) and minimal emulsification or removal visible in the microscopic examination (score (a)).

TABLE 2

| | Data presented in nanometers Examples | | | | | | | | |
|---|---|---|---|---|---|---|---|---|---|
| | 1 | 2b | 3 | 4b | 5b | 6 | 7 | 8 | 9 |
| Nonionic | 3.5 | 7.0 | — | 3.5 | 7.0 | 3.5 | — | 3.5 | 7.0 |
| Anionic | 3.5 | — | 7.0 | 3.5 | — | 3.5 | 7.0 | 3.5 | — |
| Solvent (1) (Digol) | 5 | 5 | 5 | 5 | — | — | — | — | — |
| Solvent (2) (PnB) | — | — | — | — | 5 | 5 | 5 | 5 | — |
| Oil (1) | 0.8 | 0.8 | 0.8 | — | 0.8 | 0.8 | 0.8 | — | 0.8 |
| (a) | 3 | 3 | 2 | 1 | 5 | 1 | 1 | 1 | 4 |
| (b) | 0 | 1 | 0 | 0 | 4 | 1 | 1 | 0 | 1 |
| Particle Size | 4.2 | 10.2 | 8.1 | 6.8 | 55.2 | 3.9 | 4.0 | 5.4 | 18.7 |

Comparative examples 1–4 in table 2 use a water-miscible butyl digol solvent. Example 2 of table 2 is similar to example 2 of table 1 although it has a higher co-active (solvent) level and a different oil is present. It can be seen that the particle size indicates the presence of a micellar phase in these examples.

Examples 5–8 all use the characteristic, partially miscible solvent (Dowanol PnB), but only example 5 uses this in the absence of anionic and the presence of the oil. Example 5 in table 2 is an embodiment of the invention in that it uses the partially miscible solvent, nonionic surfactant system and an insoluble oil. Comparing examples 5 and 9 it can be seen that performance is reduced markedly when the solvent is omitted (as in (9)). Comparing examples 5 and 2 from table 2, it can be seen that the use of a water-miscible solvent leads to an even further reduction in performance (as in (2)).

EXAMPLES 10–29

Further Examples and Comparatives

TABLE 3

| Ex | IMB | Solvent | Oil | Size | (a) | (b) | S/O |
|---|---|---|---|---|---|---|---|
| 10 | 7 | 5 Digol | 4 Lim | 14.8 | 2 | 2.5 | — |
| 11 | 7 | 5 IPA | 4 Lim | 17.1 | 3 | 2 | — |
| 12 | 7 | 5 PnB | 3 Dod | 16.0 | 2.5 | 2 | — |
| 13 | 7 | 5 nBuOH | 1.2 Lim | 51.4 | 4 | 3.5 | 4.17 |
| 14 | 7 | 5 PnB | 1.3 BuE | 58.6 | 5 | 3 | 3.85 |
| 15 | 7 | 5 PnB | 2.2 Lim | 30.0 | 5 | 5 | 2.28 |
| 16 | 7 | 5 PnB | 0.8 Lim | 38 | 4 | 4 | 6.25 |
| 17 | 7 | 5 Digol | 0.8 Lim | 7.5 | 1 | 1 | — |
| 18 | 7 | 5 PnB | 0.6 Dec | 140 | 2.5 | 1 | — |
| 19 | 7 | 5 PnB | 0.6 Lim | 54 | 3 | 3 | 8.33 |
| 20 | 7 | 5 PnB | 0.8 pCy | 77 | 4.5 | — | 6.25 |
| 21 | 7 | 5 PnB | 0.8 BuB | 55 | 4.5 | 3 | 6.25 |
| 22 | 7 | 5 PnB | 0.8 Dod | 15 | 1 | 1 | — |
| 23 | 7 | 5 PnB | 0.8 Cit | 52 | 1 | — | — |
| 24 | 7 | 5 PnB | 0.8 Etd | 35 | 1.5 | — | — |
| 25 | 7 | 5 PnB | 0.8 BuE | 41 | 5 | — | 6.25 |
| 26 | 7 | 5 DPnB | 0.8 Lim | 70 | 4 | — | 6.25 |
| 27 | 7 | 5 nBuOH | 0.8 Lim | 35 | 3.5 | — | 6.25 |
| 28 | 7 | 5 Cell | 0.8 Lim | 13 | 2.5 | — | — |
| 29 | 7 | 5 IPA | 0.8 Lim | 13 | 2 | — | — |

From table 3, it can be seen that it is essential that both the solvent and the oil are correctly selected. In instances where the solvent is either a miscible solvent (e.g Butyl Digol or iso-propanol as in examples 10, 11, 17 and 29) or soluble to an extent greater than 12% (e.g. Butyl Cellosolve as in example 28) or an oil is selected which does not take up fat particularly quickly (e.g. citral, dodecane, decanol or ethyl decanoate as in 12, 18, 22, 23 and 24), the performance of the compositions is markedly reduced. For the remaining examples, which are embodiments of the invention, an excess of correctly selected solvent over correctly selected oil is always present.

EXAMPLES 30–36

Concentrates

Table 4, given below, provides examples which illustrate the effect of relatively high levels of surfactant. All the compositions given in table 4 used Imbentin (IMB: as used above) as the nonionic surfactant, DOWANOL PnB as the solvent and limonine (LIM) as the oil. Drop sizes and cleaning scores (a) and (b) are as mentioned above. The appearance of the products was thin, denoted as 'tn' in all cases. Where compositions have been diluted the dilution is given under 'Dil.'

TABLE 4

| Ex | IMB | PnB | Lim | Other | App | Drop | (a) | (b) | Dil |
|---|---|---|---|---|---|---|---|---|---|
| 30 | 28 | 20 | — | — | tn | — | — | 0 | — |
| 31 | 28 | 20 | 8.8 | — | tn | 28/50 | 3 | 5 | — |
| 32 | 28 | 20 | 8.8 | — | tn | 65/95 | 4 | 5 | x4 |
| 33 | 28 | 20 | 3.2 | — | tn | 79 | 2 | 1 | — |
| 34 | 28 | 20 | 3.2 | — | tn | 34 | 4 | — | x4 |
| 35 | 28 | 20 | 3.2 | — | tn | 25 | 4 | — | x8 |
| 36 | 24 | — | — | — | tn | 6 | — | 0 | — |

From table 4, examples 31–35, it can be seen that compositions can be diluted without significant loss of cleaning effectiveness. In the case of example 33, the cleaning performance is actually improved on dilution. Examples 30 and 36 are comparative examples which are not believed to be microemulsions and exhibit poor cleaning performance.

EXAMPLES 37–47

Effect of Anionic Surfactants

Table 5, given below, provides examples which illustrate the effect of anionic surfactants. All the compositions given in table 5 used Imbentin (IMB: as used above) as the nonionic surfactant, DOWANOL PnB as the solvent and limonene (LIM) as the oil. Drop sizes and cleaning scores (a) and (b) are as mentioned above. The appearance of the products is either thin, denoted as 'tn' or thick, denoted as 'tk'. Where compositions include other components these are noted under 'other'. The other components added include: coconut fatty acid soap, DOBS 102 (TM), primary alcohol sulphate as the magnesium and sodium salts and an ethoxylated (2EO) alkyl (coconut) sulphonate (indicated as 'ethox').

TABLE 5

| Ex | IMB | PnB | LIM | Other | App | Drop | (a) | (b) |
|---|---|---|---|---|---|---|---|---|
| 37 | 24 | 14 | 8 | — | tn | 21 | — | 5 |
| 38 | 24 | 14 | 8 | 0.24 soap | tn | 14 | — | 5 |
| 39 | 24 | 14 | 8 | 1.20 soap | tk | — | — | 5 |
| 40 | 24 | 14 | 8 | 2.40 soap | tk | — | — | 5 |
| 41 | 6.93 | 5 | 0.8 | 0.07 DOBS | tn | 32 | 4 | 4 |
| 42 | 6.93 | 5 | 0.8 | 0.07 MgPAS | tn | 24 | 4 | 4 |
| 43 | 6.93 | 5 | 0.8 | 0.07 Ethox | tn | 23 | 4 | 4 |
| 44 | 6.93 | 5 | 0.8 | 0.07 NaPAS | tn | 21 | 5 | 5 |
| 45 | 6.93 | 5 | 0.8 | 0.14 NaPAS | tn | 12 | 4 | — |
| 46 | 6.93 | 5 | 0.8 | 0.35 NaPAS | tn | 6 | 3 | — |
| 47 | 6.93 | 5 | 0.8 | 0.70 NaPAS | tn | 5 | 2 | — |

From the examples of table 5 it can be seen that the presence of low levels of anionic surfactant does not significantly reduce the cleaning effectiveness. However, once the level of anionic is raised to above about 5% of the level of nonionic present, the products either become thick (as in examples 39 and 40) or the cleaning effectiveness is reduced (as in 46 and 47).

EXAMPLE 48–61

Further Examples

Table 6, given below, provides further data on samples which contain minor components and some sample where components have been omitted:

TABLE 6

| Ex. | IMB | PnB | Lim | Other | App | Drop | (a) | (b) |
|---|---|---|---|---|---|---|---|---|
| 48 | 7 | 5 | 0.8 | — | tn | 55 | 5 | 5 |
| 49 | 7 | — | — | — | tn | 8 | 0 | 1 |
| 50 | 7 | 3 | 0.8 | — | tn | 20 | 4 | 4 |
| 51 | 7 | 5 | 0.8 | 0.2 POE | tn | 19 | — | 4 |
| 52 | 7 | 5 | 2.2 | — | tn | 78/95 | 4 | 5 |
| 53 | 7 | 5 | 2.2 | 0.28 NCS | tn | 19 | 4 | 4 |
| 54 | 24 | 16 | 8 | — | tn | 22 | 5 | 4 |
| 55 | 24 | — | — | — | tn | 6 | 0 | 1 |
| 56 | 24 | 20 | — | — | tn | — | — | 2 |
| 57 | 24 | 10 | 8 | 2.0 NCS | tn | 9/19 | 4 | 4 |
| 58 | 24 | 20 | — | — | tn | — | 0 | — |
| 59 | 24 | 20 | — | 8.8 DBE | tn | — | 3 | 5 |
| 60 | 24 | 20 | — | 8.8 AA | tn | — | 3 | 4 |
| 61 | 24 | 12 | — | 8 AA | tn | — | 3 | 4 |

In Table 6, POE is polyoxyethylene oxide; NCS is sodium cumene sulphonate; DBE is dibutyl ether and AA is amyl acetate.

EXAMPLE 62–63

Modifications of Solvent.

Table 7, given below, provides further data on samples which contain DOWANOL DPnB (RTM) as the solvent.

TABLE 7

| Ex. | IMB | DPnB | Other | App. | Drop | (a) | (b) |
|---|---|---|---|---|---|---|---|
| 62 | 24 | 16 | 8 AA | tn | — | 3 | 3 |
| 63 | 24 | 16 | 8 PC | tn | — | 3 | 4 |

In Table 7, PC is p-cymene and AA is amyl acetate.

EXAMPLE 64–67

Spray Cleaning

In order to determine the spray cleaning performance of compositions according to the present invention Decamel (TM) tiles were sprayed with a model kitchen soil and the tiles thermally aged at 70° C. for 10 minutes. After cooling, the near vertical tiles were sprayed with test products using a finger pump at a distance of 8 inches from the surface. The tile was then adjusted to the horizontal position and the cleaning fluid allowed to contact the surface for 30 seconds before being rinsed under gently running water. The cleaning efficiency was assessed subjectively as (c) and the area covered by the spray measured. The results are given in table 8 below.

TABLE 8

| Ex. | IMB | PnB | Lim | Others | App. | (c) | Area |
|---|---|---|---|---|---|---|---|
| 64 | 28 | 20 | 8.8 | — | tn | 4 | 43.2 |
| 65 | 28 | 20 | 3.2 | — | tn | 3 | 25 |
| 66 | 24 | 10 | 8.0 | 4 AMP | tn | 3–4 | 27 |
| 67 | 28 | 20 | — | — | tn | 2 | 45 |

In table 8 AMP is 2-amino 2-methyl 1-propanol.

EXAMPLE 68

Modification of Soils

Small areas (approx 2.5 cm sq.) of different 'soils' were applied to Decamel tiles. The soils/stains comprised black and blue 'Permanent Marker', Biro (TM), wax crayons. 5 Drops of test solution were applied to the soiled squares and allowed to contact the surface for 30 seconds. That in contact with the 'Permanent Marker' was rinsed under the tap. That in contact with the other soils was rubbed gently and rinsed. In all cases, the microemulsion (7% Imbentin, 5% PnB, 2.2% limonene) removed significantly more of the soil than did the marketed GPC (Ajax (TM) Liquid). EXAMPLE 67–75

Determination of Interfacial Tension

Interfacial tension for compositions according to the present invention was determined after 30 min equilibration using a Kruss spinning drop tensiometer SITE 04 (TM) operating at 22–23 Celcius, 2000–3000 rpm in accordance with the manufacturers instructions and injecting olive oil (ex Sigma). Results are presented in table 9 below:

TABLE 9

| Ex. | Imbentin 91 wt % | PnB wt % | Oil wt % | Interfacial Tension |
|---|---|---|---|---|
| 67 | 7 | 0 | 0 | 1.84 |
| 68 | 7 | 5 | 0 | 1.50 |
| 69 | 7 | 0 | 0.8 Lim | 1.70 |
| 70 | 7 | 5 | 0.8 Lim | 0.80 |
| 71 | 7 | 5 | 2.2 Lim | 0.26 |
| 72 | 7 | 5 | 1.5 BuE | 0.35 |
| 73 | 7 | 5 | 1.5 EtD | 0.70 |
| 74 | 7 | 5 | 0.8 Cit | 0.54 |
| 75 | 24 | 10 | 8.0 Lim (+ 2% NCS) | 0.25 |

From table 9 it can be seen that the low interfacial tension is only found when each of the surfactant, solvent and oil are present. However, as will be noted from examples 73 and 74, low interfacial tension is also found with the ethyl decanoate and citral containing samples which do not show effective cleaning in samples 23 and 24 as explained above this is believed to be due to the fat dissolving behaviour of these components.

The above-mentioned results are summarised in FIG. 1, which is a graph showing the relationship between the emulsification properties and the particle size in the microemulsion. The particle size is that measured by means of photon correlation spectroscopy using a MALVERN 4700, PCS 100 (TM) spectrometer and recorded in TABLES 1–3, whereas the 'Emulsification' score used in FIG. 1 is an average of scores (a) and (b) where both are available or simply score (a) or (b) when only this figure was available.

Turning to FIG. 1, it can be seen that all of the compositions given in TABLE 1 show relatively poor emulsification behaviour. The majority of the compositions listed in TABLE 1 have a particle size which falls in region 'A' and is characteristic of micellar phase liquids.

Although example 5 from TABLE 1 exhibits the particle size characteristics of a microemulsion as herein defined, its emulsification performance is poor. It is believed that this poor performance is due to the presence of an entirely water-miscible solvent system. In FIG. 1 it is believed that compositions in region 'D' may be microemulsions or may be swollen micelles. Compositions in region 'D' generally exhibit little improvement in spontaneous emulsification behaviour as compared with non-microemulsion micellar compositions found in region 'A'.

From FIG. 1 it can also be seen that the compositions of TABLE 2, with the exception of example 5 from TABLE 2 again show a micellar particle size and poor emulsification behaviour.

Example 5 from TABLE 2 falls within region 'C' in FIG. 1 and is believed to be a microemulsion as defined herein.

The other embodiments of the invention which fall into region 'C' are taken from TABLE 3.

As mentioned above region 'D' in FIG. 1 can include microemulsions which exhibit poor spontaneous emulsification behaviour. Such compositions are illustrated by examples 23 and 24 from TABLE 3. It will be noted that these compositions use the less preferred oils.

Examples falling within region 'B' of FIG. 1 are believed to comprise a rod- or lamellar-phase structure. Such compositions are illustrated by example 18 from TABLE 3, wherein the substitution of decanol for limonene is believed to lead to the formation of a rod phase. Similar results were obtained with formulations comprising 7% Imbentin, 5% Butyl Cellosolve and 1.6% decanol, in which the particle size was measured at 440 nm.

Data from table 4 shows the effect of dilution.

Data from table 5 shows the effect of increasing levels of anionic surfactant. It can be seen that as the level of anionic is increased the cleaning performance falls sharply. It is believed that the presence of significant amounts of anionic surfactant destroys the microemulsion structure.

We claim:

1. A liquid, aqueous cleaning composition in the form of a stable emulsion having a dispersed phase diameter of 10–100 nanometers comprising:

a) at least 30 wt. % water;

b) 1 to 24 wt. % ethoxylated nonionic surfactant selected from the group consisting of condensation products of ethylene oxide with aliphatic alcohols having from 8 to 22 carbon atoms in either straight or branched chain configuration, c) 2.0 to 16 wt. % of a solvent selected from the group consisting of n-butanol, iso-butanol, n-butoxy propanol, di-propylene glycol monobutyl ether and mixtures thereof, d) at least 0.2 but less than 10 wt. % of an oil selected from the group consisting of limonene, para-cymene, di-butyl ether, butyl butyrate, amyl acetate and mixtures thereof, and wherein said composition comprises not more than 10 wt. % anionic surfactant based on the weight of total ethoxylated nonionic surfactant present.

2. Composition according to claim 1 comprising less than 5 wt. % anionic surfactant based on the weight of total ethoxylated nonionic surfactant present.

3. Composition according to claim 1 comprising 5.0 to 10 wt. % of said ethoxylated nonionic surfactant, 3.0 to 8.0 wt. % of said solvent and 0.8 to 4.0 wt. % of said oil.

4. Composition according to claim 1 comprising 20 to 24 wt. % of said ethoxylated nonionic surfactant, 12 to 16 wt. % of said solvent and 4.0 to 10.0 wt. % of said oil.

5. A method of cleaning a hard surface which comprises the step of contacting the surface with a composition according to claim 1.

* * * * *